United States Patent [19]

Buente et al.

[11] Patent Number: 4,715,334

[45] **Date of Patent: * Dec. 29, 1987**

[54] SELF CONTAINED HYDRAULIC BUCKET LIFTER

[75] Inventors: Stephen M. Buente; George A. Hillebrand, both of Battle Creek, Mich.

[73] Assignee: Eaton Corporation, Cleveland, Ohio

[ * ] Notice: The portion of the term of this patent subsequent to Aug. 25, 2004 has been disclaimed.

[21] Appl. No.: 864,561

[22] Filed: May 16, 1986

Related U.S. Application Data

[63] Continuation of Ser. No. 559,127, Dec. 7, 1983, abandoned.

[51] Int. Cl.[4] ..... F02L 1/24

[52] U.S. Cl. ..... 123/90.58; 123/90.55

[58] Field of Search ..... 123/90.43, 90.46, 90.55, 123/90.58

[56] References Cited

U.S. PATENT DOCUMENTS

| | | | |
|---|---|---|---|
| 2,109,815 | 3/1938 | Best | 123/90 |
| 2,553,756 | 5/1951 | Engemann | 123/90 |
| 2,694,388 | 11/1954 | Gammon et al. | 123/90 |
| 2,746,437 | 5/1956 | Van Slooten | 123/90 |
| 2,761,433 | 9/1956 | Kilgore | 123/90 |
| 2,804,060 | 8/1957 | Bergmann | 123/90 |
| 2,871,839 | 2/1959 | Mekkes | 123/90 |
| 2,925,074 | 1/1958 | Dadd | 123/90 |
| 2,962,012 | 11/1960 | Howson | 123/90 |
| 3,025,842 | 3/1962 | Van Slooten | 123/90 |
| 3,170,446 | 2/1965 | Dolza | 123/90 |
| 3,521,608 | 7/1970 | Scheibe | 123/90.58 |
| 3,670,707 | 6/1972 | Guido | 123/90.57 |
| 4,191,142 | 3/1980 | Kodama | 123/90.58 |
| 4,274,370 | 6/1981 | Kodama | 123/90.55 |
| 4,338,894 | 7/1982 | Kodama | 123/90.58 |
| 4,368,699 | 1/1983 | Kodama | 123/90.58 |
| 4,373,477 | 2/1983 | Buente et al. | 123/90.46 X |
| 4,385,599 | 5/1983 | Hori et al. | 123/90.58 |
| 4,387,675 | 6/1983 | Hori et al. | 123/90.58 |
| 4,397,271 | 8/1983 | Gardner | 123/90.55 |
| 4,402,285 | 9/1983 | Arai et al. | 123/90.58 |
| 4,470,381 | 9/1984 | Buente et al. | 123/90.55 |

FOREIGN PATENT DOCUMENTS

| | | | |
|---|---|---|---|
| 2754446 | 6/1979 | Fed. Rep. of Germany | 123/90.55 |
| 2942926 | 5/1981 | Fed. Rep. of Germany | 123/90.55 |
| 160106 | 12/1980 | Japan | 123/90.58 |

*Primary Examiner*—William R. Cline
*Assistant Examiner*—Peggy Neils
*Attorney, Agent, or Firm*—D. A. Rowe; F. M. Sajovec

[57] ABSTRACT

A hydraulic lash adjusting tappet (10) for use in engine valve gear of the direct-acting type have one end of the tappet contacting the end (26) of the combustion chamber valve stem (22) and the other end contacting the camshaft lobe (16). The tappet has a body (34) formed with a tubular wall portion (36) having one end thereof closed by an end wall (38) and with a tubular hub (40) therewithin formed integrally with the end wall and extending axially therefrom. A lash adjuster assembly (44) is slidingly received in the tubular hub which defines a reaction surface (50) remote from the cam face reaction surface (18) defined by the end wall. A seal (88) defines an expansible closed fluid reservoir (114) in combination with the body and includes a compliant diaphragm (90) carried about the outer circumferential portion (92) thereof by said body and a sleeve cap (52) insert-molded within the inner circumferential portion (110) of the diaphragm to provide a central portion (104) wear surface interposed, in application, between the lash adjuster reaction surface and the valve stem.

18 Claims, 5 Drawing Figures

SELF CONTAINED HYDRAULIC BUCKET LIFTER

This application is a continuation of Ser. No. 559,127 filed Dec. 7, 1983, now abandoned.

FIELD OF THE INVENTION

The present invention relates generally to hydraulic valve lifters and the like for maintaining substantially zero lash in motion-transmitting mechanisms such as, for example, cam-operated valves of internal combustion engines, and particularly to hydraulic valve lifters of the bucket-type which directly interconnect the cam and valve stem of an overhead cam and valve engine. More specifically, the present invention relates to hydraulic valve lifters of the self-contained type within direct-acting valve gear.

BACKGROUND OF THE INVENTION

In designing valve gear for internal combustion engines operating at speeds in excess of 5,000 RPM, it has been found desirable to employ valve gear of the cam-over-valve type. Valve gear of this type is known as direct-acting valve gear and employs a tappet having one end contacting the engine camshaft with the other end of the tappet in direct contact with the end of the stem of the combustion chamber valve. Direct-acting valve gear offers the advantages of low mass, fewer working parts and higher stiffness due to the elimination of the rocker arm and/or push rods. Low mass and high stiffness result in a high natural resonant frequency which allows the valve gear to attain higher RPM's before valve mismotion occurs. Direct-acting valve gear also permits the use of lighter valve spring loads for a given valve motion and engine speed as compared with those used in other valve gear arrangements. The low mass and high stiffness of the system also permits valve lift velocities and accelerations which increase the area under the valve lift curve and thus provide increased specific engine output. Although other overhead cam configurations can be made to have comparable lift velocities and accelerations, a direct-acting valve gear arrangement offers the additional advantage of permitting rotation of the cam-contacting surfaces as the lifter rotates, which is not permissible with rocker arm type valve gear arrangements. Direct-acting valve gear arrangements, therefore, allow higher permissible cam contact stresses.

In addition, the cam profile for other overhead cam valve gear arrangements with high lift accelerations and velocities is more complex than that required for direct-acting valve gear. The simpler cam profile requirement of direct-acting valve gear results in less manufacturing difficulties and less cost in the valve gear when high velocities and accelerations are desired.

Conventional lash adjusters compensate for fluid leakage by means of supplying pressurized fluid to the interior of the lash adjuster through passageways in the cylinder block. However, there are disadvantages to such an arrangement since the passageways through which the pressurized fluid flows are complicated in construction, and the operation is often unstable due to changes in the viscosity of the pressurized fluid. In order to eliminate such disadvantages, hydraulic lash adjusters of the self-contained type have been provided which are not fed from an external source of hydraulic fluid but which contain their own source of such fluid.

Self-contained lash adjusters overcome many of the shortcomings of conventional lash adjuster arrangements. Because no external source of hydraulic fluid is required, self-contained lash adjusters are easily applied to engines since no oil galleries are required. Furthermore, because no fluid is supplied to the outside diameter of the adjuster, leakage therefrom will not collect within the engine block and head as has been heretofore experienced. Because self-contained lash adjusters do not communicate with their host engine's hydraulic (lubrication) system, they do not become subject to the contaminants and air bubbles contained therein. The presence of air-free hydraulic fluid within a lash adjuster is desirable, particularly in reducing cold-start cavitation which, in the worst case, can collapse the lash adjuster. Additionally, by containing its own reservoir of hydraulic fluid, a self-contained lash adjuster has the potential for improved control over leakdown specification tolerances by selective use of hydraulic fluid having a viscosity differing from that of the host engine fluid. A still further advantage of self-contained lash adjusters is their independence of engine fluid pressure which tends to be high during cold-start conditions and low at hot idle.

Although having many advantages over conventional lash adjuster arrangements, prior art self-contained lash adjusters have a number of shortcomings. Because self-contained lash adjusters, by definition, have no outside source of hydraulic fluid, the fluid contained therein at the time of manufacture must remain intact for the life of the lash adjuster. Accordingly, a virtually perfect seal is required to prevent any self-contained lash adjuster hydraulic fluid from escaping. Providing such a seal has been the Achilles' heel of virtually all prior art commercial self-contained lash adjusters. Much of the prior art patent literature recognizes this problem and concedes that some leakage is inevitable by providing arrangements for compensating for limited amounts of hydraulic fluid loss. More specifically, the sealing problems inherent to all self-contained lash adjusters have two distinct aspects. First, all such lash adjusters require an absorption chamber to account for differential volumes of reservoir fluid. The shortcoming, in most prior art absorption chambers, lies in the attempt to establish a seal between two reciprocating elements. Such motion tends to substantially reduce the life of the seal through fatigue embrittlement and the like. The second aspect is the sealing function of the high-pressure portion of the lash adjuster. Most prior art approaches involve a dynamic or sliding seal which, by its nature, is susceptible to mechanical wear from sliding contact against less-than-perfect surface finishes. A still further problem inherent to self-contained lash adjusters is the requirement for some form of antirotation device between the lash adjuster piston and the body, which allows relative axial reciprocating motion but prevents relative rotation therebetween, to prevent torsional stressing of the interconnecting membrane seal. Furthermore, assembly of prior art self-contained lash adjusters is often complicated by the necessity to purge all air from the assembled unit. A typical manufacturing process can require assembly of the lash adjuster while submerged within hydraulic fluid.

It has been found difficult to provide direct-acting valve gear in engine applications where the height of the engine must be kept to a minimum and, consequently, the camshaft located closely adjacent the end of the combustion chamber valve stem. Furthermore, where it is desired to retrofit a hydraulic lash-adjusting tappet into the direct-acting valve gear of a production engine, it is often difficult to provide a hydraulic lash-adjusting tappet in the space provided between the camshaft and the end of the valve stem. Since the tappet must be guided in the bore defined by engine structure intermediate the camshaft and the end of the valve stem the engine height tends to somewhat increase.

Therefore, it has been desired to find a self-contained hydraulic lash-adjusting tappet with a compact profile height for use in engines having direct-acting valve gear with minimum distance between the camshaft and the end of the valve stem to minimize the mass of engine structure necessary to provide the tappet guides. Furthermore, in designing tappets for direct-acting valve gear so as to minimize sideloading in the guide for minimizing wear, it is desirable to have the reaction force of the valve stem centered through the tappet at a point as closely adjacent the cam surface as possible. Locating the reaction force near the cam face also permits the tappet to be designed to minimize the mass which, in turn, reduces inertia.

Known hydraulic tappets for self-contained direct-acting valve gear have employed a body or bucket, formed as an integral unit having a reservoir defined by the closed end of the body and an annular diaphragm, such as that shown and described in U.S. Pat. No. 3,521,608 to Scheibe, wherein the diaphragm is retained about the outer circumference thereof to the body and engages the plunger portion of the lash adjuster at the inner circumference thereof. Although providing a bucket type self-contained lash adjuster with a relatively small profile, seal arrangements such as that shown in the Scheibe lifter can have shortcomings when the device is applied to certain applications, particularly those requiring long life and minimal hydraulic fluid leakage. Such a device overcomes some of the above-described shortcomings of other prior art devices by eliminating need for a dynamic seal. However, the requirement of a fluid-tight absorption chamber requires life-long seal integrity. In the applicants' experience, problems in prior art designs of this type often arise in the area of interface between the valve stem and plunger assembly. Because the lash adjusting mechanism axially reciprocates at this point, seals tend to deteriorate rapidly by pulling away from a host member or embrittle and rupture at a point of maximum excursion.

SUMMARY OF THE INVENTION

The present invention provides a self-contained hydraulic lash adjusting tappet of the type used in direct-acting valve gear for internal combustion engines operating at high RPM. The hydraulic tappet of the present invention is of the type having a general configuration known as a "bucket" wherein the body of the tappet has a diameter substantially larger than that of the hydraulic plunger contained therein. The present invention overcomes many of the shortcomings of the prior art by providing a design which eliminates the need for a dynamic seal, reduces high transient pressures on the diaphragm to enhance seal life, provides an extremely small profile and provides ease of assembly. The self-contained hydraulic lash adjusting tappet of the present invention includes a body with structure defining an outer annular wall closed at one end thereof by a transversely extending end wall and an annular hub therein. Hydraulic lash adjusting means are received within the hub and define a reaction surface which, in application, contacts one or more associated components of the valve gear of the host engine for effecting lash adjustment thereof. Finally, seal means are provided which, in combination with the body means, define an expansible closed fluid reservoir. The seal means includes a compliant diaphragm having an outer circumferential portion thereof retained within the body means to establish a fluid-tight seal therebetween and a floating central portion defining a wear face which, in application, is interposed between and radially restrained by a reaction surface defined by the lash adjuster means and one of said associated components of the engine valve gear such as the end of the valve stem. This arrangement provides a relatively low-cost design with a seal configured to minimize the stresses imposed thereon by the operation of the tappet to thereby maximize the sealing integrity afforded thereby and the life expectancy thereof.

In the Preferred Embodiment of the Invention, accumulator means are provided, which communicate with the fluid reservoir and operate to absorb reservoir fluid pressure transients associated with operation of the lash adjuster by localized bending deformation. This arrangement provides the advantage of reducing the shock-stressing of pressure transients imposed on the seal diaphragm to enhance the life thereof.

According to another aspect of the present invention, the above-described accumulator means is defined by one or more displacement pockets integrally formed, such as by molding, with the seal diaphragm and extending within the fluid reservoir at a point radially intermediate the outer wall of the hub body structure. The pocket(s) has the outer surfaces thereof normally communicating with fluid in the reservoir and the inner surfaces normally communicating with ambient pressure, typically the atmosphere. In the preferred embodiment, a plurality of such displacement pockets are formed in the diaphragm which are circumferentially arranged within the fluid reservoir and interspaced by generally radially extending web portions which add rigidity to the overall diaphragm assembly. This arrangment provides the advantage of an extremely strong seal diaphragm, which has one or more accumulators attached thereto whereby hydraulic fluid pressure transients from operation of the tappet are absorbed by the accumulators through bending displacement thereof rather than compression or tension loading of the diaphragm itself.

According to another aspect of the invention, a sleeve cap is insert-molded with an inner circumferential portion of the diaphragm to define the above-mentioned wear surface. The sleeve cap defines a central portion which is interposed, in the preferred application of the present invention, between the reaction surface of the lash adjuster and the end of the engine valve stem. This arrangement has the advantage of keeping the seal assembly discreet from the lash adjuster assembly to aid in the manufacture of the tappet. Furthermore, the likelihood of separation between the sleeve cap and the diaphragm is minimized by the insert molding of the cap therein.

According to another aspect of the present invention, an access bore is provided between a check valve within the high-pressure portion of the lash adjuster assembly and the lash adjuster reaction surface. This arrangement has the advantage of enabling a probe to be inserted through the bore for overriding of the check valve for purging air from the high-pressure portion of the lash adjuster assembly during manufacture.

According to still another aspect of the present invention, a lash adjuster assembly retainer is provided which operates to limit axial displacement of the lash adjuster assembly to a limit less extensive than the position of the lash adjuster assembly when air was initally purged therefrom to prevent establishing a negative pressure within the lash adjuster. Simultaneously, the retainer also prevents relative rotational displacement between the lash adjuster assembly and the body to prevent torsional stressing of the diaphragm.

These and other aspects and advantages of the present invention will become apparant upon reading the following Specification which, along with the application drawings, describes and discloses a preferred embodiment of the invention as well as modifications thereof, in detail.

A detailed description of the Embodiment of the Invention makes reference to the accompanying drawings.

DETAILED DESCRIPTION 0F THE PREFERRED EMBODIMENTS OF THE INVENTION

Figure 1:
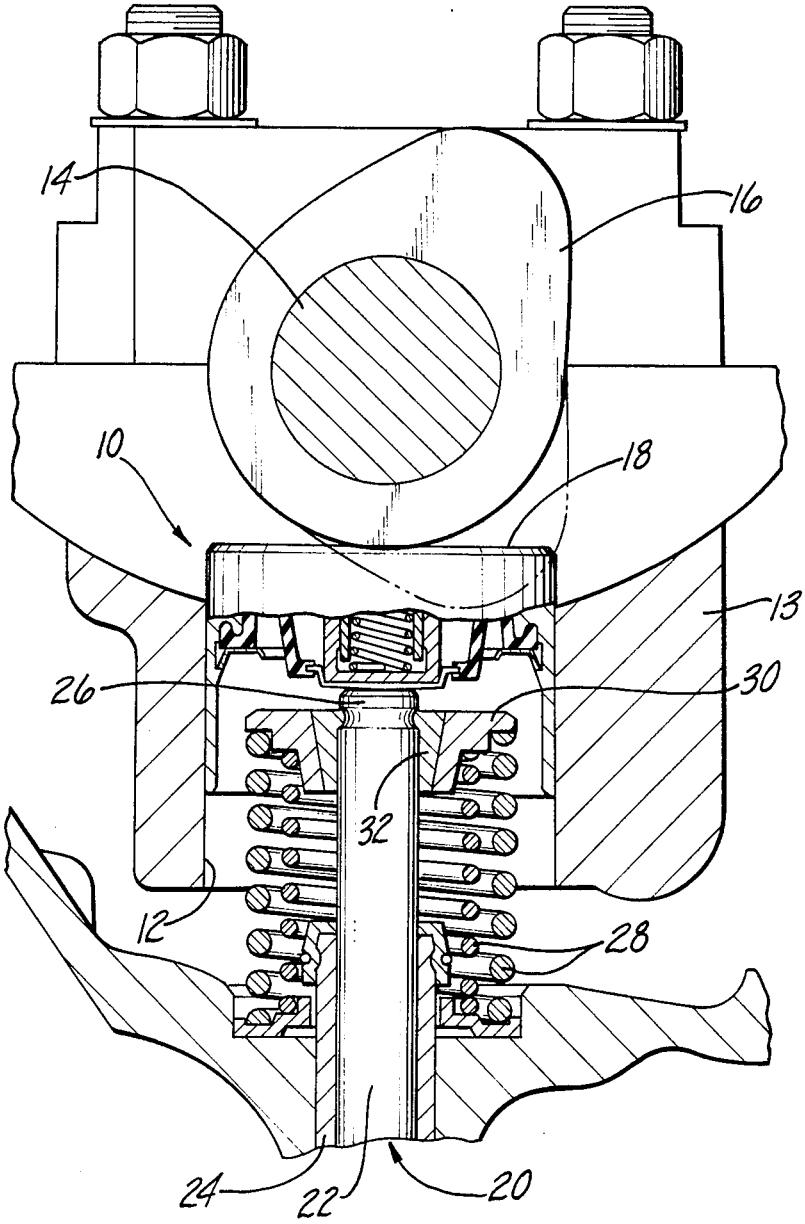
FIG. 1 is a cross section of a portion of the direct-acting valve gear of an internal combustion engine illustrating the tappet as installed in the engine.

Referring to FIG. 1, a bucket indicated generally at 10 is slidably received in a guide bore 12 provided in the cylinder head 13 of the engine structure. A camshaft 14 having a cam lobe 16 contacts the upper end or cam face reaction surface 18 of the tappet. A typical combustion chamber valve 20 is shown seated on a valve seating surface formed in the cylinder head 13 with the stem portion 22 of the valve extending substantially vertically upward through a valve guide 24 formed in the cylinder head 13, with the upper end 26 of the valve stem contacting the lower end of the tappet. The valve is biased to the closed position by concentric valve springs 28, having their lower ends registered against the exterior of the upper portion of the valve guide 24 and their upper ends in contact with a retainer 30 secured to the valve stem adjacent its upper end and retained thereon in a suitable manner, as for example, by the use of a split keeper 32 which is well-known in the art.

Figure 4:
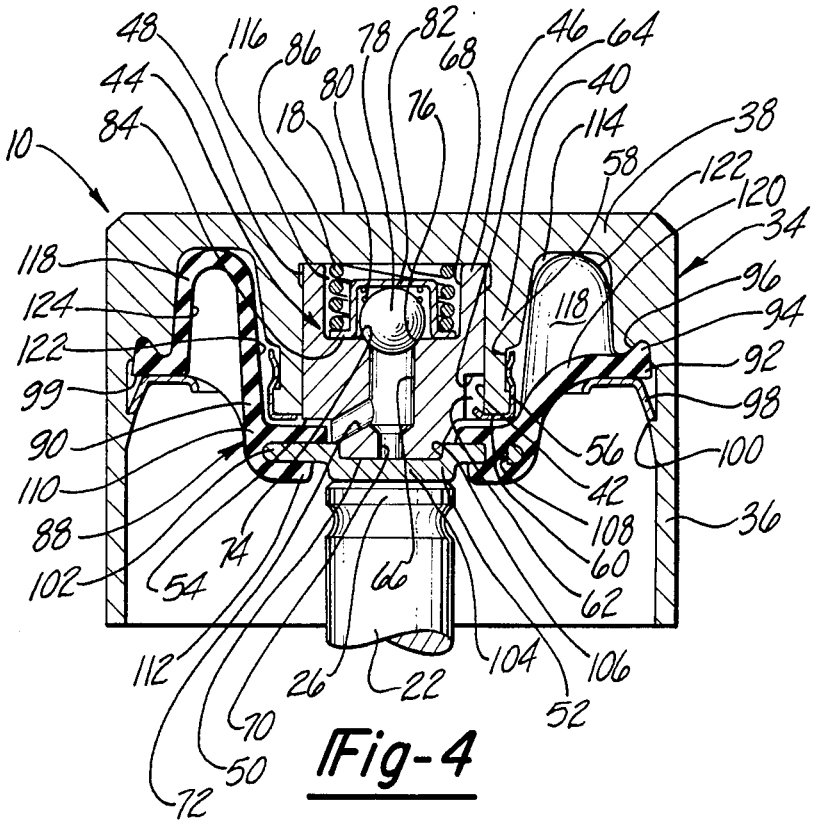
FIG. 4 is a cross-sectional view of a second alternative and the currently preferred embodiment of the tappet illustrated in FIG. 2.
Figure 5:
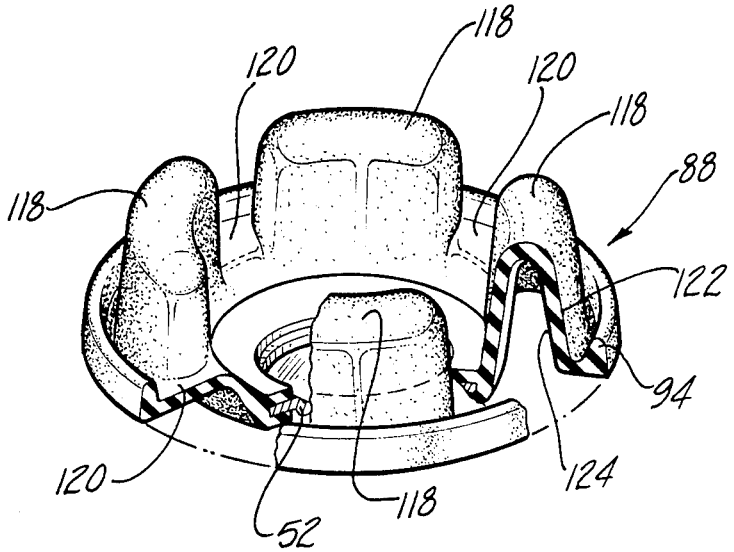
FIG. 5 is a prospective broken view of the seal assembly of the tappet of FIG. 4.

Referring now to FIGS. 4 and 5, the presently preferred embodiment of the tappet 10 is shown wherein the body, indicated generally at 34, is formed preferably integrally with an outer tubular wall portion 36 closed at one end by a transversely extending end wall 38. The upper or outside surface of end wall 38 defines cam face reaction surface 18. A tubular hub portion 40 is integrally formed with end wall 38 within outer wall 36 and extends downwardly therefrom. Hub 40 defines a lash adjuster assembly receiving bore 42 opening downwardly and in general axial alignment with outer wall 36. A lash adjuster assembly, indicated generally at 44, is slidably received within bore 42. The outer periphery of outer wall 36 is sized to be received in the tappet guide bore 12 (see FIG. 1) in a generally closely fitting relationship. Although the outer wall, web and hub have been described as preferably formed integrally, it will be understood that such portions may be formed separately and the body formed by joining those portions, as for example, by weldment, such as fusion or brazing.

In the presently preferred practice, the tappet body is formed of a suitable steel alloy as, for example, an alloy containing a desired amount of chromium and is suitably hardened for wear resistance. However, it is contemplated that the body could be formed from iron-based material as, for example, steel or cast iron and a separate disc-shaped face member welded thereto to define cam face reaction surface 18. It will also be understood that other materials, for example, nickel alloys may be used or hardenable cast iron or ceramic materials, or cermets may be employed if desired.

Lash adjuster assembly 44 includes a plunger 46 having the outer periphery 48 thereof in sliding closely fitting relationship with bore 42. Outer periphery 48 and bore 42 comprise leakdown surfaces, the function of which will be described in detail hereinbelow. The plunger 46 has a transverse face 50 thereof, or lower face with respect to FIG. 4, adapted for driving engagement with the end 26 (see FIG. 1) of the combustion chamber valve stem through an intermediate sleeve cap 52, the function of which will be described hereinbelow.

In the presently preferred practice, the plunger 46 is formed of steel with face 50 suitably hardened for wear resistance. The outer periphery 48 of the plunger 46 has an annular shoulder 54 formed thereon at the intersection with the lower face 50. An annular retainer 56 is received on the open end of hub 40 and engaged therewith, preferably in a groove 58 formed in the outer periphery of hub 40. Retainer 56 has one or more tangs 60 extending radially inward of bore 42, each registering within a local nitch 62. The uppermost extent of nitch 62 defines a local step 64. Tang 60 operates to limit axial displacement of plunger 46 at the point where tang 60 contacts step 64. Simultaneously, tang 60 operates to prevent substantial relative rotational repositioning of plunger 46 and body 34. Plunger 46 is illustrated in its collapsed or upwardmost limit of travel.

Plunger 46 has a fluid passage 66 formed vertically and preferably centrally with a counterbore 68 formed therein. The bottom end of passage 66 includes a concentric probe bore 70 and a radially extending vent passage or oil feed hole 72 interconnecting fluid passage 66 with outer periphery 48 of plunger 46 at a point adjacent shoulder 54. Counterbore 68 has a flat bottom 74 which intersects passage 66 in an annular seating surface 76. A one-way valve member in the form of a check ball 78 rests against the annular seating surface 76 and is biased thereagainst by a suitable expedient as, for example, a conical check ball spring 80. The check ball 78 is retained by a cage 82 which has an outwardly extending flange 84 received in counterbore 68 and retained therein by suitable means as, for example, a press fit. The cage 82 is provided with one or more apertures or passageways (not shown) to enable the flow of fluid therepast. The subassembly of the check ball, cage and plunger 46 is biased downwardly by a plunger spring 86 having its upper end registered against the closed end of bore 42 and its lower end registered against flange 84 of check ball cage 82.

A seal assembly, indicated generally at 88, is received within body 34 and includes a generally annular compliant diaphragm 90 formed preferably of rubber or other suitable material and sleeve cap 52. The outer circumferential portion 92 of diaphragm 90 has a bead 94 formed therein, which is nestingly received within a complementarily shaped annular mating surface 96 in outer wall 36 and retained therein by an annular spring clip 98, which is held in position by an annular radially inwardly directed shoulder 100 formed on the inner surface of outer wall portion 36. Spring clip 98 is dimensioned so as to bear against lower surface 99 of outer circumferential portion 92 and thereby partially compress bead 94 against surface 96 to ensure a fluid-tight seal therebetween.

Sleeve cap 52 is a rigid, generally disc-shaped member, formed preferably of steel, including an annular rim portion 102 and a recessed central portion 104 joined by an intermediate step 106. Rim portion 102 has a number of apertures 108 formed therein in a circumferentially spaced pattern. Diaphragm 90 has an inner circumferential portion 110 defining an area of increased thickness 112. Rim portion 102 of sleeve cap 52 is insert-molded within area of increased thickness 112 wherein the material comprising diaphragm 90 has flowed at least partially through apertures 108 to ensure positive retention and sealing engagement therebetween.

The lowermost portion of plunger 46 nests within sleeve cap 52 whereby transverse face 50 thereof abuts the upper surface of recessed central portion 104. The lower surface of recessed central portion 104 abuts the upper end 26 of stem portion 22 of valve 20. In application, sleeve cap 52 is always sandwiched or biased between plunger 46 and valve stem 22 and operates to passively throughput valve gear forces. Step 106 in sleeve cap 52 abuts the outer surface of plunger 46 formed by shoulder 54 to positively locate sleeve cap 52 in its illustrated position. Thus, in operation, sleeve cap 52 and the radially innermost portion of diaphragm 90 is free to reciprocate with plunger 46 and valve stem 22 but is prevented from radial displacement with respect to body 34 by its nesting engagement with plunger 46. Sleeve cap 52 could be reconfigured to nestingly engage upper end 26 of valve stem portion 22 if desired. In its broadest sense, the present invention contemplates any form of radial restraint effected upon the "wear surface" of the seal, such as pure coefficient of friction of the sandwiching plunger 46 and upper portion 26, obviating the need for "nesting". Such radial restraint takes place in application only. Otherwise, the wear surface floats or self-locates adjacent the lash adjuster reaction surface.

Seal assembly 88 and body 34 coact to define an expansible closed-fluid reservoir 114. Fluid in reservoir 114 is communicated to check ball 78 through vent passage or oil feed hole 72 and fluid passage 66. The region above check ball 78 and seating surface 76 and bounded by counterbore 68 and bore 42 of hub 40 comprises a high-pressure fluid chamber 116 for retaining therein fluid entering through passage 66 upon opening of the check ball 78.

Diaphragm 90 has integrally formed therein four upwardly directed displacement pockets 118 which are circumferentially spaced by intermediate radially extending web portions 120 of diaphragm 90. Each displacement pocket 118 has outer surfaces 122 communicating with fluid within reservoir 114 and inner surfaces 124 communicating with ambient pressure, which in intended application, will be the atmosphere. Although four displacement pockets 118 are illustrated, it is contemplated that one or more could be employed. However, if two or more are used, they should be interspaced by web portions 120. Displacement pockets 118 are intended to function as resilient accumulators which momentarily absorb reservoir fluid pressure transients associated with lash adjustment when plunger 46 is repositioned and fluid exits from between leakdown surfaces 42 and 48. Although all transient phenomena and forces upon diaphragm 90 have not been analyzed in detail, the applicants surmise that the improved operation observed after including the displacement pockets is a result of reduced tension and compression forces imposed on diaphragm 90. Momentary collapsing displacement of displacement pockets 118 imposes almost pure bending forces thereon, lowering total positive pressure on diaphragm 90 and therefore enhancing the predicted life thereof.

In operation, check ball 78 is biased in a closed position by spring 80 and upon rotation of the camshaft in timed relationship with the events of the combustion chamber to the position shown in solid outline in FIG. 1, the upper surface 18 of tappet 10 is registered against the base circle portion of the cam with the lobe 16 oriented so as not to contact the cam face 18 of the tappet. Upon rotation of the camshaft 14 to the position shown in dashed outline in FIG. 1, the cam lobe contacts the cam face reaction surface 18 of the tappet 10, causing the tappet to move downwardly, thereby opening the combustion chamber valve 20. Upon subsequent rotation of the camshaft to return to the solid outline position of FIG. 1, the valve event is complete and the valve is reseated on the valve seat.

In operation, with the engine cam lobe 16 in the position shown in FIG. 1, the plunger spring 86, aided by hydraulic pressure in fluid chamber 116, maintains the lower face 50 of plunger 46 in contact with the upper surface of recessed central portion 104 of sleeve cap 52 which, in turn, is maintained in contact with upper end 26 of valve stem 22 thereby eliminating lash in the valve gear. This causes expansion of chamber 116, which draws open the check ball 78 permitting fluid to flow into chamber 116 from passage 66. Upon succession of the expansion of chamber 116, the check ball 78 closes under the biasing of spring 80. Upon subsequent rotation of cam lobe 16, the ramp of the cam lobe begins to exert a downward force on the upper face 18 of the tappet, tending to compress the plunger 46 into bore 42, which compression is resisted by fluid trapped in chamber 116. The fluid trapped in chamber 116 is to prevent substantial movement of the plunger 46 relative to body 34, and it transmits the motion through the bottom face 50 of plunger 46 onto the top of valve stem 26 through sleeve cap 52. It will be understood by those having ordinary skill in the art that a minor movement of the plunger 46 with respect to body 34 occurs, the magnitude of which is controlled by the amount of fluid permitted to pass through the aforesaid leakdown surfaces 42 and 48. The plunger and body thus act as a rigid member transmitting further lifts of cam lobe 16 for opening the valve to the position shown by dashed line in FIG. 1.

Probe bore 70 is provided to facilitate assembly of tappet 10 by providing a passageway between face 50 of plunger 46 and check ball 78.

In-process verification of the subassembly comprising body 34 and lash adjuster assembly 44 can be effected prior to installation of seal assembly 88 by inserting a probe through bore 70 in passage 66 to momentarily displace check ball 78 from seating surface 76. Once seal assembly 88 is installed, probe bore 70 serves no further purpose.

Figure 3:
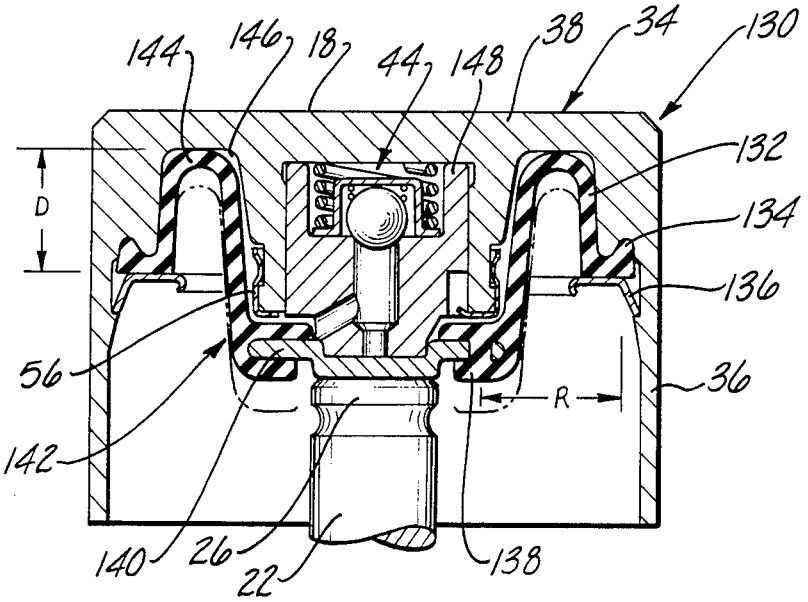
FIG. 3 is a cross-sectional view of an alternative embodiment of the tappet illustrated in FIG. 2.

Referring to FIG. 3, an alternative embodiment of the bucket tappet is shown generally at 130 as employing a circumferentially symmetrical rolled or convoluted type diaphragm 132 having an outer peripheral bead 134 retained in position by a spring clip 136 and an inner peripheral area of increased thickness 138 with an annular rim portion of a sleeve cap 140 insert-molded therein to comprise a seal assembly indicated generally at 142. Diaphragm 132 has a convolution 144 extending within a fluid reservoir 146. Definitionally, "convolutions" are to be interpreted for the purposes of this application and any patent issuing therefrom as meaning one or more roll or undulation of diaphragm 132. Operation of bucket tappet 130 is substantially as disclosed and described in connection with the discussion of the embodiment illustrated in FIGS. 4 and 5 hereinabove. As shown by phantom line, convolution 144 will roll with inner peripheral area 138 as plunger 148 is displaced outwardly. Although the dimensions of diaphragm 132 will vary as a function of actual application, it is contemplated that the following general relationships will remain true. Convolution 144 will extend axially a nominal dimension indicated at D which is dimensionally substantially coextensive with the nominal radial spacing (designed R) of the bead 134 and area of increased thickness 138.

Figure 2:
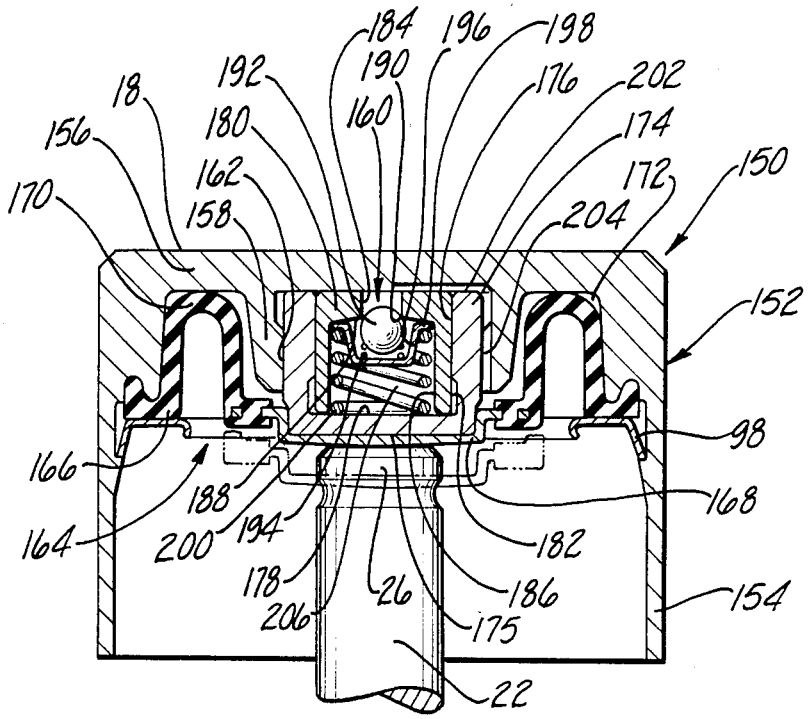
FIG. 2 is a cross-sectional view of the tappet illustrated in FIG. 1 showing the internal details thereof.

Referring to FIG. 2, a second alternative embodiment of a bucket tappet 150, is illustrated, including a body with structure defining an outer tubular wall portion 154, a transversely extending end wall 156 and an annular hub 158. A lash adjuster assembly 160 is slidingly received within a bore 162 defined by hub 158. Finally, a seal assembly 164 completes the assembly and includes a compliant diaphragm 166 and a central insert-molded sleeve cap 168. With the exceptions discussed hereinbelow, bucket tappet 150 operates substantially identically as the preferred embodiment discussed hereinabove with respect to FIGS. 4 and 5.

Diaphragm 166, like diaphragm 132 (refer FIG. 3) is circumferentially symmetrical and includes a convolution 170 extending within a fluid reservoir 172. The inner periphery or bore 162 of hub 158 has received therein a plunger 174 in sliding closely fitting relationship therewith. Plunger 174 has a transverse face thereof, or lower face with respect to FIG. 2, adapted for nesting engagement with sleeve cap 168 for driving valve stem 22. No retainer is illustrated in the embodiment of FIG. 2 although it is contemplated that one would be employed in practice for the reasons set forth hereinabove.

Plunger 174 has a precision cylindrical bore 176 formed in the upper end thereof with the lower end thereof terminating in a shouldered flat bottom 178. The precision bore 176 has slidably received therein in very closely fitting relationship a piston member 180, the outer periphery 182 thereof being of precision diameter and smoothness so as to provide control of the leakdown or passage of pressurized fluid therebetween. In the presently preferred practice, both the plunger 174 and the piston 180 are formed of a suitable steel material.

Piston 180 has a fluid passage 184 formed vertically and preferably centrally therethrough. The bottom end of the passageway 180 has a counterbore 186 provided in the lower end of piston 180 which counterbore has a generally flat top 188 which intersects the passageway 184 in an annular seating surface 190. A one-way valve member in the form of a check ball 192 rests against the annular seating surface 190, and is biased thereagainst by a suitable expedient as, for example, a check ball spring 194. The check ball 192 is retained by a cage 196 which has an outwardly extending flange 198 received in counterbore 186 and retained therein by a suitable means as, for example, a press fit. The cage 196 has an aperture (not illustrated) to allow fluid communication thereby. The subassembly of the check ball 192, cage 196 and piston 180 is biased upwardly by a plunger spring 200 having its upper end registering against flange 198 of the check ball cage 196 and its lower end contacting the bottom 178 of the plunger 174.

Fluid passage 184 communicates with reservoir 172 through a series connected radially extending bypass recess 202 formed in the lower surface of end wall 156 and an axially extending bypass recess 204 formed in bore 162 of hub 158. Bypass recesses 202 and 204 function to maintain passageway 184 and reservoir 172 in continuous fluid communication. It will be understood that piston 180 is maintained in the upward extreme position and against the undersurface of end wall 156, as illustrated in FIG. 2 by spring 200 and the hydraulic pressure in chamber 206.

The region 206 below check ball 172 and seat 190 and bounded by bore 186 of piston 180, bore 176 of plunger 174 and bottom 178 of plunger 174 comprise a high-pressure fluid chamber for retaining therein fluid entering passage 184 upon opening of the check ball 192.

In operation, check ball 192 is biased in a closed position by spring 194 and upon rotation of the camshaft in timed relation to the events of the combustion chamber to the position shown in solid outline in FIG. 1, the upper surface of the tappet is registered against the base circle of the cam with the lobe 16 oriented so as not to contact the cam face 18 of the tappet. Upon rotation of the camshaft 14 to the position shown in dashed outline in FIG. 1, the cam lobe contacts the upper face 18 of the tappet, causing the tappet to move downwardly, thereby opening the combustion chamber valve. Upon subsequent rotation of the camshaft to return to the solid outlined position of FIG. 1, the valve event is complete and the valve is reseated on the valve seat. In operation, with the engine cam lobe 16 in the position shown in FIG. 1, the plunger spring 200, aided by hydraulic pressure, maintains the upper end of piston 180 in contact with the under surface of end wall 156 and urges the plunger 174 in the downward direction until the end face 175 thereof contacts the upper face 26 of the valve stem 22 (through sleeve cap 168) thereby eliminating lash in the valve gear. This causes expansion of the chamber 206 which draws open the check ball 192 permitting fluid to flow into chamber 206. Upon succession of expansion of chamber 206, the check ball 192 closes under the biasing of spring 194. Upon subsequent rotation of the cam lobe 16, the ramp of the cam lobe begins to exert a downward force on the upper face 18 of the tappet tending to compress the piston 180 into the bore 176 of the plunger which compression is resisted by the fluid trapped in chamber 206. The fluid trapped in chamber 206 prevents substantial movement of the piston 180 relative to plunger 174 and transmits the motion through the bottom face of plunger 174 onto the top of the valve stem 26. It will be understood by those having ordinary skill in the art that a minor movement of the plunger with respect to the piston occurs, the magnitude of which is controlled by the amount of fluid permitted to pass through the aforesaid leakdown surfaces 176 and 182. The piston 180 and plunger 174 thus act as a rigid member transmitting further lifts of cam lobe 16 for opening the valve.

The novel construction of the tappet 150 illustrated in FIG. 2 provides the lash adjustment by a precision fit of a piston in a bore formed in a plunger slidably received in the hub, and thus eliminates the need for precision fitting leakdown control surfaces on the interior of the tappet hub. The external retention means illustrated in the embodiments of FIGS. 3 and 4 permit ease of manufacture and ready removal of the hydraulic plunger assembly for cleaning and/or parts replacement. Furthermore, spring clips 98 and 136 provide effective substantially fluid-tight seals between the outer circumference of the diaphragm and the body while permitting disassembly and service, if required, without destruction or degradation of the tappet.

It is to be understood that the invention has been described with reference to specific embodiments which provide the features and advantages previously described, and that such specific embodiments are susceptible of modification as will be apparent to those skilled in the art. Accordingly, the foregoing description is not to be construed in a limiting sense.

What is claimed is:

1. A self-contained hydraulic lash adjuster for use in the valve gear of an internal combustion engine, said tappet comprising:

(a) body means including structure defining, (i) an outer annular wall having the outer periphery thereof forming a wear resistance surface;

(ii) a transversely extending end wall substantially closing one end of said outer wall and defining an outwardly exposed cam face surface, and (iii) an annular hub disposed within said outer wall and spaced therefrom;

(b) hydraulic lash adjusting means moveably received within said hub, said lash adjusting means including structure defining a reaction surface adapted for contacting associated components of the engine valve gear, said reaction surface extending generally parallel to said cam face surface and being moveable with respect thereto, said lash adjusting means including means defining a fluid pressure chamber and one-way valve means operable to admit fluid to said chamber for altering and hydraulically holding the position of said reaction surface with respect to said cam face surface for lash adjustment in said valve gear, said lash adjusting means further including means biasing said surface away from said cam face reaction surface; and (c) seal means extending generally transversely within said outer annular wall and operative to define in combination with said body means an expansible closed fluid reservoir for communication with said fluid pressure chamber, characterized in that said seal means includes:

(i) a generally annular compliant diaphragm with an outer circumferential portion thereof carried within said body means and forming a fluid-tight seal therebetween; and, (ii) a rigid cap member having a plurality of spaced apertures therethrough with an inner circumferential portion of said diaphragm molded over the periphery of said cap member with said diaphragm material received in said apertures for providing positive engagement of said diaphragm with said cap member to provide a seal therebetween and to accommodate movement of said lash adjusting means upon installation of the tappet in the valve gear of an engine, said cap member operative to transmit forces in the valve train from said reaction surface.

2. The lash adjuster tappet of claim 1, wherein the outer circumferential portion of said diaphragm defines an area of increased thickness contoured to complimentarily conform with a mating surface defined by said body means, and further comprising retainer means engaging said body means for compressive loading of said area of increased thickness to effect said fluid-tight seal.

3. The lash adjuster of claim 1, wherein said retainer comprises an annular spring clip concentrically disposed within said body and engaging the inner surface of said outer wall.

4. The last adjuster of claim 1, wherein the inner circumferential portion of said diaphragm defines an area of increased thickness and said sleeve cap has an annular rim portion having said apertures formed therein, said area of increased thickness being formed of a material which, upon said insert molding, substantially fills said apertures.

5. The lash adjuster of claim 1, further comprising means engaging the outer periphery of said hub for retaining said lash adjusting means within said hub.

6. The lash adjuster of claim 1, wherein said hub structure includes a circumferential groove formed in the outer periphery thereof with retaining means comprising an annular spring clip engaging said circumferential groove for retaining said lash adjusting means in said hub.

7. The lash adjuster of claim 1, wherein said lash adjusting means further comprises a probe bore extending between said reaction surface and said one-way valve means whereby a probe inserted through said bore prior to installation of said seal means within said within said body means is operative to effect a momentary opening of said one-way valve means for establishing communication between said pressure chamber and fluid reservoir.

8. A self-contained hydraulic lash adjusting tappet for use in the valve gear of an internal combustion engine, said tappet comprising:

(a) body means including structure defining, (i) an outer annular wall;

(ii) a transversely extending end wall substantially closing one end of said outer wall and defining a cam face reaction surface, and (iii) an annular hub within said outer wall;

(b) hydraulic lash adjusting means received within said hub and defining a reaction surface adapted for contacting associated components of the engine valve gear for effecting lash adjustment thereof; and, (c) seal means defining an expansible closed fluid reservoir in combination with said body means and including a compliant diaphragm having an outer circumferential portion thereof retained within said body means to establish a fluid-tight seal therebetween, said diaphragm having formed therein, resilient accumulator means defined by inner and outer circumferential wall portions of said diaphragm configured to project into said fluid reservoir and operative to absorb reservoir fluid pressure transients associated with said lash adjustment by localized deformation thereof.

9. A self-contained hydraulic lash adjuster for use in the valve gear of an internal combustion engine, said lash adjuster comprising:

(a) body means including structure defining;
(i) an outer annular wall;
(ii) a transversely extending end wall substantially closing one end of said outer wall and defining a cam face reaction surface, and
(iii) an annular hub within said outer wall said hub depending from said transverse wall;

(b) hydraulic lash adjusting means slidably received within said hub and defining a reaction surface adapted for contacting associated components of the valve gear for effecting lash adjustment thereof; and (c) seal means defining an expansible closed fluid reservoir in combination with said body means characterized in that said seal means includes a compliant annular diaphragm having an outer circumferential portion thereof retained within said body means to establish a fluid-tight seal therebetween; and;

(d) a floating rigid central member contacting said reaction surface and operative to transmit load therefrom, said central member having a plurality of retention surfaces therein extending generally in the axial direction of said annular diaphragm with the inner periphery of said annular diaphragm received over said central member and having a portion of the material of said diaphragm defining a plurality of surfaces disposed generally axially of said diaphragm in positive engagement with said retention surfaces for acting thereagainst to resist forces acting on said diaphragm tending to cause separation therefrom and for providing fluid pressure sealing engagement of said diaphragm inner periphery with said central member as said seal means moves to accommodate movement of said lash adjusting means during engine operation.

10. A self-contained hydraulic lash adjuster for use in the valve gear of an internal combustion engine, said lash adjuster comprising:

(a) body means including structure defining,
(i) an outer annular wall;
(ii) a transversely extending end wall substantially closing one end of said outer wall and defining a cam face reaction surface, and
(iii) an annular hub within said outer wall said hub depending from said transverse wall;

(b) hydraulic lash adjusting means slidably received within said hub and including a member defining a reaction surface and operative to hydraulically displace said reaction surface with respect to said cam face surface and hold said displacement for lash adjustment of said valve gear; and (c) seal means defining an expansible closed fluid reservoir in combination with said body means for communicating with said lash adjusting means, characterized in that said seal means includes
a compliant annular diaphragm having an outer circumferential portion thereof retained within said body means to establish a fluid-tight seal therebetween; said diaphragm integrally defining a plurality of circumferentially spaced displacement pockets extending within said reservoir radially intermediate said outer wall and hub structure, each said pockets deformable resiliently for absorbing pressure transients occurring in the reservoir fluid.

11. A self-contained hydraulic lash adjuster for use in the valve gear of an internal combustion engine, said lash adjuster comprising:

(a) body means including structure defining,
(i) an outer annular wall;
(ii) a transversely extending end wall substantially closing one end of said outer wall and defining a cam face reaction surface, and
(iii) an annular hub disposed within said outer wall;

(b) hydraulic lash adjusting means slidably received within said hub for effecting lash adjustment and including a reaction surface; and (c) seal means defining an expansible closed fluid reservoir in combination with said body means and including a compliant diaphragm having an outer circumferential portion thereof retained within said body means to establish a fluid-tight seal therebetween, and a rigid central portion contacting said hub means reaction surface for transmitting valve train forces to associated valve gear components, said seal means including resilient accumulator means extending intermittently about the circumference of said diaphragm and separated by radial web portions of said diaphragm wherein said accumulator means are operative to absorb reservoir fluid pressure transients associated with said lash adjustment by localized deformation thereof.

12. The lash adjuster of claim 10, wherein said seal means further comprises a rigid sleeve cap member having a plurality of retention surfaces disposed about the periphery thereof and extending generally in the axial direction of said annular diaphragm with the inner circumferential portion of said diaphragm received thereover with the material of said diaphragm molded over and positively engaging said retention surfaces, and acting thereagainst to resist forces in said diaphragm tending to pull said diaphragm inner periphery away from said cap member and to provide fluid pressure sealing engagement therewith, said cap member operative, upon installation in the engine valve gear, for transmitting cam loads from said reaction surface to associated components of the engine valve gear.

13. The lash adjuster of claim 9, further comprising accumulator means extending circumferentially over a portion of said annular diaphragm communicating with said fluid reservoir and operative to absorb by localized deformation reservoir fluid pressure transients associated with said lash adjustment.

14. The lash adjuster of claim 9, wherein said diaphragm includes accumulator means comprising at least one diaplacement pocket extending within said reservoir radially intermediate said outer wall and hub structure.

15. The lash adjuster of claim 9, wherein said diaphragm includes accumulator means comprising a plurality of circumferentially spaced displacement pockets formed integrally with said diaphragm and extending with said reservoir radially intermediate said outer wall and hub structure.

16. The lash adjuster of claim 10, wherein said lash adjusting means reaction surface comprises a cupped configuration engaging a shouldered surface on said lash adjusting means for restraining radial movement of said seal means.

17. The lash adjuster of claim 10, further comprising retaining means operative to substantially prevent relative rotation between said lash adjusting means within said hub in a direction away from said cam surface.

18. The lash adjuster of claim 10, further comprising retaining means operative to limit axial displacement of said lash adjusting means within said hub in a direction away from said cam surface.

* * * * *